US007456572B2

(12) United States Patent
Hong et al.

(10) Patent No.: US 7,456,572 B2
(45) Date of Patent: Nov. 25, 2008

(54) PLASMA DISPLAY PANEL AND METHOD OF MANUFACTURING BACK PANEL THEREOF

(75) Inventors: Chong-Gi Hong, Asan-si (KR); Tae-Kyoung Kang, Asan-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 229 days.

(21) Appl. No.: 10/958,643

(22) Filed: Oct. 6, 2004

(65) Prior Publication Data

US 2005/0093446 A1 May 5, 2005

(30) Foreign Application Priority Data

Oct. 9, 2003 (KR) ..... 10-2003-0070284

(51) Int. Cl.
*H01J 17/49* (2006.01)

(52) U.S. Cl. ..... 313/582; 313/587; 345/60

(58) Field of Classification Search ..... 313/582–587, 313/495–497; 445/24–25; 345/60
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,729,086 A * 3/1998 Jeong et al. ..... 313/495

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Toan Ton
*Assistant Examiner*—Hana A Sanei
(74) *Attorney, Agent, or Firm*—Robert E. Bushnell, Esq.

(57) ABSTRACT

A Plasma Display Panel (PDP) includes: a front panel having a front plate and a plurality of electrodes arranged on a surface of the front plate in a predetermined pattern and a back panel having a back plate facing the front plate, a plurality of electrodes arranged on a surface of the back plate in a predetermined pattern to correspond to the plurality of electrodes of the front plate, and at least one ventilation hole. At least two back plates are formed by cutting one base plate on which at least two ventilation holes are formed. Each ventilation hole has a first width in a first edge direction of the back plate and a distance from the first edge to a center of the at least one ventilation hole is at least twice that of the first width.

10 Claims, 7 Drawing Sheets

U.S. PATENT DOCUMENTS

| | | | | |
|---|---|---|---|---|
| 5,786,794 | A | | 7/1998 | Kishi et al. |
| 5,844,360 | A | * | 12/1998 | Jeong et al. ..... 313/495 |
| 5,952,782 | A | | 9/1999 | Nanto |
| 6,155,900 | A | * | 12/2000 | Hofmann et al. ..... 445/24 |
| RE37,444 | E | | 11/2001 | Kanazawa |
| 6,320,560 | B1 | * | 11/2001 | Sasaki et al. ..... 345/60 |
| 6,531,818 | B1 | * | 3/2003 | Normanni ..... 313/582 |
| 6,630,916 | B1 | | 10/2003 | Shinoda |
| 6,707,436 | B2 | | 3/2004 | Setoguchi et al. |

FOREIGN PATENT DOCUMENTS

| | | | |
|---|---|---|---|
| JP | 9-17343 | | 1/1997 |
| JP | 2845183 | | 10/1998 |
| JP | 2917279 | | 4/1999 |
| JP | 2001-043804 | | 2/2001 |
| JP | 2001-325888 | | 11/2001 |
| JP | 2002293580 | A * | 10/2002 |
| JP | 2003-132790 | | 5/2003 |
| JP | 2003217457 | A * | 7/2003 |
| JP | 2003-242896 | | 8/2003 |

OTHER PUBLICATIONS

Japanese Office action corresponding to Japanese Patent Application No. 2004-294196, issued on May 29, 2007.

* cited by examiner

PLASMA DISPLAY PANEL AND METHOD OF MANUFACTURING BACK PANEL THEREOF

CLAIM OF PRIORITY

This application makes reference to, incorporates the same herein, and claims all benefits accruing under 35 U.S.C. §119 from an application for PLASMA DISPLAY PANEL COMPRISING A BACK PANEL AND MANUFACTURING METHOD OF THE BACK PANEL OF PLASMA DISPLAY PANEL earlier filed in the Korean Intellectual Property Office on 9 Oct. 2003 and there duly assigned Serial No. 2003-70284.

BACKGROUND OF THE INVENTION

1. Field of the Invention

The present invention relates to a Plasma Display Panel (PDP) and a method of manufacturing a back panel of the PDP, and more particularly, to a PDP that forms an image by applying a discharge voltage to a plurality of electrodes arranged on two substrates facing each other to generate ultraviolet rays which excite phosphor layers and a method of manufacturing the back panel.

2. Description of the Related Art

Plasma display panels (PDPs) can be classified into Direct Current (DC) PDPs and Alternating Current (AC) PDPs. In the DC PDP, electrodes are exposed in a discharging space, and charged particles move directly between the corresponding electrodes. In the AC PDP, at least one electrode is covered by a dielectric layer, and a discharge occurs using an electric field of a wall charge instead of a charge directly moving between the electrodes.

An AC PDP includes a front panel and a back panel. The front panel includes a front plate. X electrodes and Y electrodes are arranged in pairs on the front plate, and address electrodes crossing the X and Y electrodes are arranged on a surface of a back plate facing the front plate. The X and Y electrodes on the front plate are transparent electrodes made of Indium-Tin-Oxide (ITO), and are also referred to as transparent electrodes. In addition, bus electrodes, which are formed of metal and have narrow widths for reducing line resistance, are arranged on an upper portion of the transparent electrodes. A discharge space forming a unit discharge cell is defined by a pair of X and Y electrodes and the address electrode crossing the pair of X and Y electrodes.

A front dielectric layer and a back dielectric layer are arranged on the front plate where the X and Y electrodes are arranged and on the surface of the back plate where the address electrodes are arranged to cover the electrodes. A protective layer is arranged on the front dielectric layer, and a barrier rib that maintains a discharge distance and prevents cross-talk between discharge cells is arranged on the back dielectric layer. Red, green, and blue phosphor layers are arranged on both surfaces of the barrier rib and an upper surface of the back dielectric layer where the barrier rib is not formed. The front panel and the back panel are sealed by a sealing unit, for example, a frit.

When a discharge cell is selected for emitting light, a predetermined voltage is applied to the address electrode and the Y electrode of the selected discharge cell. Then, an address discharge. occurs and a wall charge is generated on the front dielectric layer. When a predetermined voltage is applied between the X electrode and the Y electrode, the wall charge moves between the two electrodes to cause the discharge gas to undergo a sustaining discharge and to generate ultraviolet rays. Then, the ultraviolet rays excite the phosphor layer to form an image.

A PDP can be divided into an image area H that can display an image and a non-image area N that cannot display an image. On the image area H, the address electrodes, the X electrodes, and the Y electrodes are connected to a driving circuit that drives the address electrodes and the X and Y electrodes, and accordingly, the image can be displayed in response to signals from the driving circuit. On the non-image area N, at least one of the address electrode, the X electrode, and the Y electrode is not connected to the driving circuit so that an image cannot be displayed there. The back panel 30 includes a back plate terminal area C, on which the address electrodes are connected to a driving unit that drives the address electrodes.

A ventilation hole is arranged in the non-image area N.

The ventilation hole, coupled with a ventilation pipe that is arranged on a back surface of the back plate, simultaneously serves as a path through which gas remaining in an outer part of the PDP can be discharged after joining the front plate and the back plate, and as a path through which the remaining gas that is generated in fabricating the front plate and the back plate and joining the plates can be exhausted to the ventilation pipe and a gas, such as Ne or Xe, can enter the PDP. Thus, the ventilation hole, together with the ventilation pipe, performs both a vacuum induction role and a gas path role.

However, the ventilation hole of the PDP is formed by a hole forming unit, such as a drill, from the upper surface of the back panel 30 to the lower surface, or in the opposite direction. Thus, when the operation of forming the hole in the back plate is completed, the back plate becomes more vulnerable to damage. Specifically, the surface of the back plate becomes rough, and the area around the ventilation hole is prone to cracking.

In addition, only one back plate is fabricated from a base plate and a remaining portion of the base plate that is not included in the back plate is discarded. This increases manufacturing overhead of the back plate.

In order to solve the above problem, recently, one base plate is cut to manufacture a plurality of back plates. Thus, the excluded portion of the base plate can be reduced, and the manufacturing cost of the back plate can be reduced.

However, when the ventilation hole is not distanced from the cut by more than a predetermined threshold length, the area around the ventilation hole is even more prone to cracking, and the back plate can be damaged. Specifically, since an end portion of the back plate is coupled to a jig during manufacture and handling, stress is applied to the crack, and the back plate can be damaged more.

SUMMARY OF THE INVENTION

The present invention provides a Plasma Display Panel (PDP), which includes a back plate having a structure that prevents cracking around a ventilation hole and damage to a periphery of the ventilation hole caused by a jig used to move the back plate, and a method of manufacturing the back panel of the plasma display panel.

According to an aspect of the present invention, a plasma display panel is provided comprising: a front panel including a front plate; a plurality of electrodes arranged on a surface of the front plate in a predetermined pattern; a back panel including a back plate facing the front plate; a plurality of electrodes arranged on a surface of the back plate in a predetermined pattern to correspond to the plurality of electrodes of the front plate; and at least one ventilation hole having a first width in a first edge direction of the back plate and a distance from the first edge to a center of the at least one ventilation hole being at least twice that of the first width.

The distance from the first edge of the back plate to the center of the at least one ventilation hole is preferably at least 2.3 times that of the first width.

The at least one ventilation hole has a second width in a direction of a second edge that intersects the first edge, and a distance from the second edge to the center of the at least one ventilation hole is preferably at least 1.1 times that of the second width.

The distance from the second edge to the center of the at least one ventilation hole is preferably at least 1.23 times that of the second width.

The at least one ventilation hole preferably has a circular shape.

According to another aspect of the present invention, a plasma display panel is provided comprising: a front panel including a front plate and a plurality of electrodes arranged on a surface of the front plate in a predetermined pattern; and a back panel including a back plate facing the front plate, a plurality of electrodes arranged on a surface of the back plate in a predetermined pattern to correspond to the plurality of electrodes of the front plate, and at least one ventilation hole; wherein the at least one ventilation hole has a first width in a direction of a first edge of the back plate, on which a back plate driving terminal unit is arranged, and wherein a distance from the first edge to a center of the at least one ventilation hole is at least twice that of the first width.

The distance from the first edge to the center of the at least one ventilation hole is preferably at least 2.3 times that of the first width.

The at least one ventilation hole has a second width in a direction of a second edge of the back plate that intersects the first edge, and a distance from the second edge to the center of the at least one ventilation hole is preferably at least 1.1 times that of the second width.

The distance from the second edge to the center of the at least one ventilation hole is preferably at least 1.23 times that of the second width.

The at least one ventilation hole preferably has a circular shape.

According to still another aspect of the present invention, a method of manufacturing a back panel in a plasma display panel is provided, the method comprising: forming a plurality of electrodes on a base plate that includes a plurality of back plates; forming at least one ventilation hole on each back plate by drilling into the back plate from corresponding positions on upper and lower surfaces of the back plate; and cutting the base plate into at least two back plates.

In forming at least one ventilation hole on each back plate, the at least one ventilation hole which has a first width in a direction of a first edge of the back plate is formed so that a distance from the first edge to the center of the at least one ventilation hole is preferably at least twice that of the first width.

The at least one ventilation hole is formed so that the distance from the first edge to the center of the at least one ventilation hole is preferably at least 2.3 times that of the first width.

In forming at least one ventilation hole on each back plate, the at least one ventilation hole which has a second width in a direction of a second edge of the back plate crossing the first edge is formed so that a distance from the second edge to the center of the at least one ventilation hole is preferably at least 1.1 times that of the second width.

The distance from the second edge to the center of the at least one ventilation hole is preferably at least 1.23 times that of the second width.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
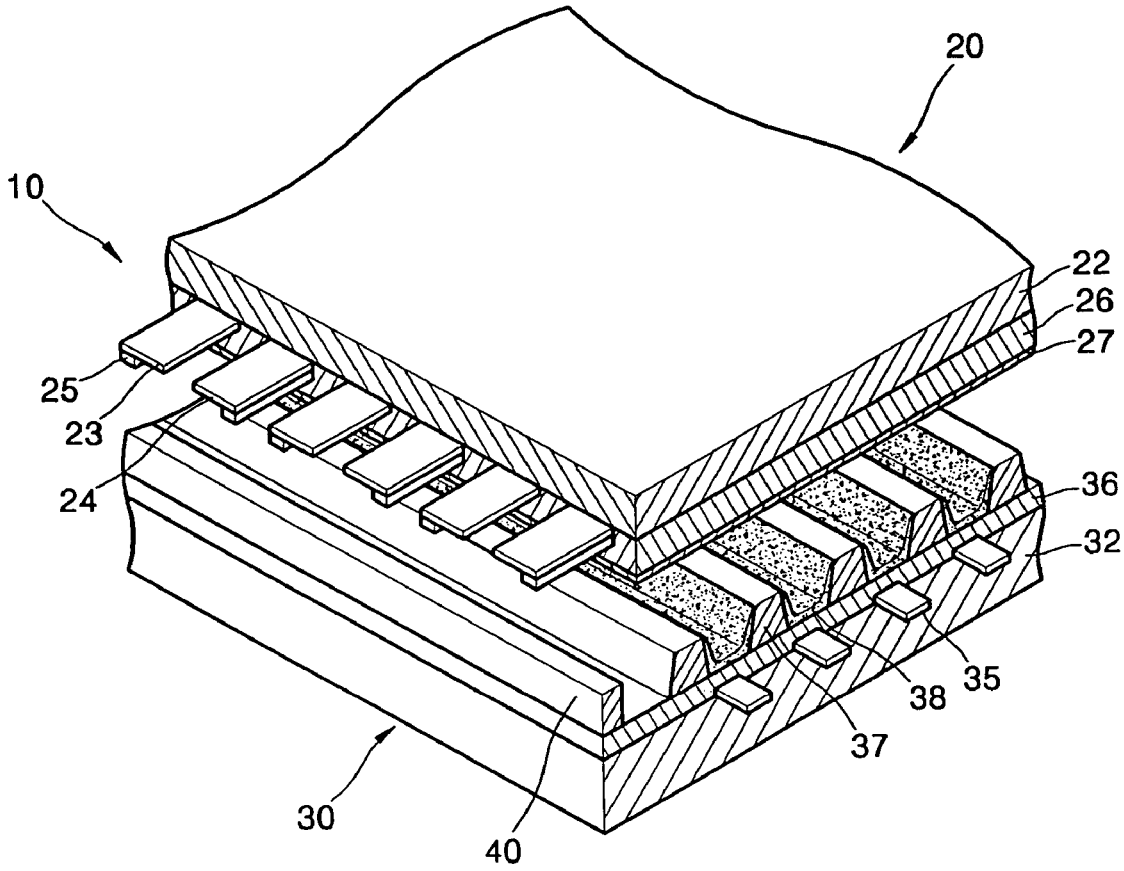
FIG. 1 is a schematic perspective view of an Alternating Current (AC) Plasma Display Panel (PDP)

As shown in FIG. 1, a general AC type PDP 10 includes a front panel 20 and a back panel 30. The front panel 20 includes a front plate 22. X electrodes 23 and Y electrodes 24 are arranged in pairs on the front plate 22, and address electrodes 35 crossing the electrodes 23 and 24 on the front plate 22 are arranged on a surface of a back plate 32 facing the front plate 22. The X and Y electrodes 23 and 24 on the front plate 22 are transparent electrodes made of Indium-Tin-Oxide (ITO), and are also referred to as transparent electrodes. In addition, bus electrodes 25, which are formed of metal and have narrow widths for reducing line resistance, are arranged on an upper portion of the transparent electrodes. A discharge space forming a unit discharge cell is defined by a pair of X and Y electrodes 23 and 24 and the address electrode 35 crossing the pair of X and Y electrodes 23 and 24.

A front dielectric layer 26 and a back dielectric layer 36 are arranged on the front plate 22 where the X and Y electrodes 23 and 24 are arranged and on the surface of the back plate 32 where the address electrodes 35 are arranged, so that the electrodes are covered. A protective layer 27 is arranged on the front dielectric layer 26, and a barrier rib 37, that maintains a discharge distance and prevents cross-talk between discharge cells, is arranged on the back dielectric layer 36. Red, green, and blue phosphor layers 38 are arranged on both surfaces of the barrier rib 37 and an upper surface of the back dielectric layer 36 where the barrier rib 37 is not formed. The front panel 20 and the back panel 30 are sealed by a sealing unit 40, for example, a frit.

When a discharge cell is selected for emitting light, a predetermined voltage is applied to the address electrode 35 and the Y electrode 24 of the selected discharge cell. Then, an address discharge occurs and a wall charge is generated on the front dielectric layer 26. When a predetermined voltage is applied between the X electrode 23 and the Y electrode 24, the wall charge moves between the two electrodes 23 and 24 to cause the discharge gas to undergo a sustaining discharge and to generate ultraviolet rays. Then, the ultraviolet rays excite the phosphor layer 38 to form an image.

Figure 2:
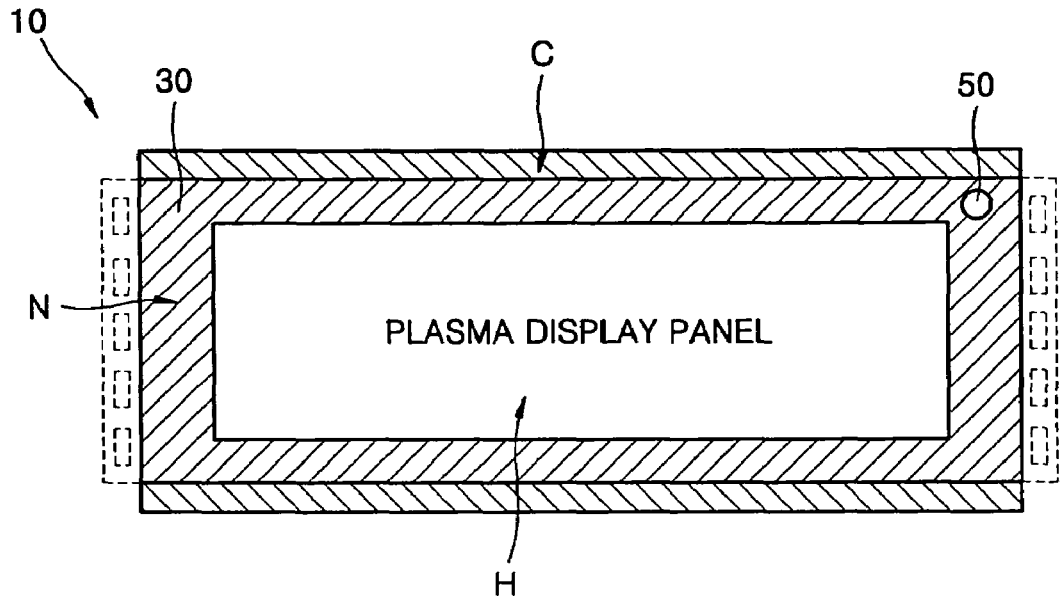
FIG. 2 is a plan view of a ventilation hole arranged in a PDP area of a back panel of the PDP of FIG. 1.

Referring to FIG. 2, the PDP 10 can be divided into an image area H that can display an image and a non-image area N that cannot display an image. On the image area H, the address electrodes, the X electrodes, and the Y electrodes are connected to a driving circuit that drives the address electrodes and the X and Y electrodes, and accordingly, the image can be displayed in response to signals from the driving circuit. On the non-image area N, at least one of the address electrode, the X electrode, and the Y electrode is not connected to the driving circuit so that an image cannot be displayed there. The back panel 30 includes a back plate terminal area C, on which the address electrodes are connected to a driving unit that drives the address electrodes.

A ventilation hole 50 is arranged in the non-image area N.

The ventilation hole 50, coupled with a ventilation pipe that is mounted on a back surface of the back plate, simultaneously serves as a path through which gas remaining in an outer part of the PDP can be discharged after joining the front plate to the back plate, and as a path through which the remaining gas, generated in fabricating the front plate and the back plate and joining the plates, can be exhausted to the ventilation pipe and a gas, such as Ne or Xe, can enter the PDP. Thus, the ventilation hole 50, together with the ventilation pipe, performs both a vacuum induction role and a gas path role.

The ventilation hole 50 of the PDP is formed by a hole forming unit such as a drill from the upper surface of the back panel 30 to the lower surface, or in the opposite direction. After the operation of forming the hole in the back plate has been completed, the back plate becomes more vulnerable to damage. Specifically, the surface of the back plate becomes rough, and the area around the ventilation hole is prone to cracking.

In addition, only one back plate is fabricated from a base plate and a remaining portion of the base plate that is not included in the back plate is discarded. This increases the manufacturing cost of the back plate.

In order to solve the above problem, recently, one base plate has been cut to manufacture a plurality of back plates 32. This reduces both the discarded portion of the base plate and the manufacturing cost of the back plate 32.

However, when the ventilation hole 50 is not distanced from the cut by more than a predetermined threshold length, the area around the ventilation hole 50 is even more prone to cracking, and the back plate 32 can be damaged. Specifically, since an end portion of the back plate 32 is coupled to a jig during manufacture and since stress is applied and the back plate can be damaged.

Hereinafter, exemplary embodiments of the present invention will be described with reference to the accompanying drawings. In the drawings, whenever the same element reappears in a subsequent drawing, it is denoted by the same reference numeral.

Figure 3:
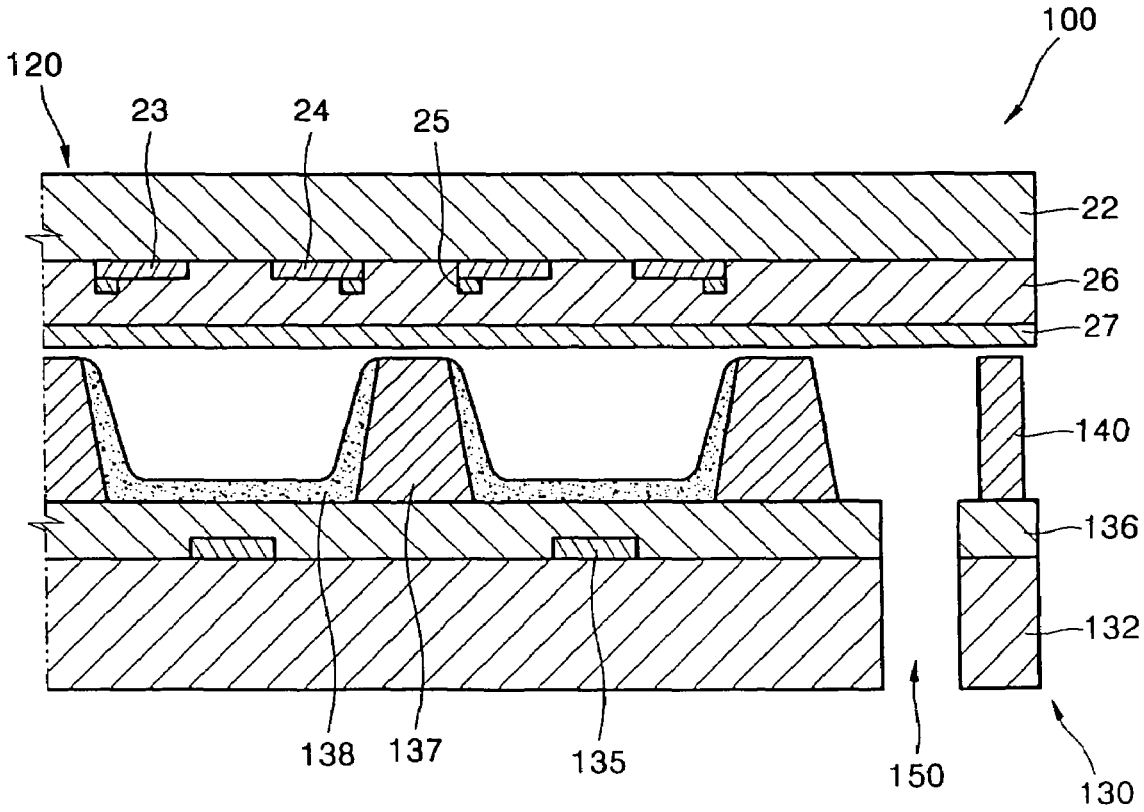
FIG. 3 is a cross-sectional view of a PDP according to a first embodiment of the present invention.

Referring to FIG. 3, a Plasma Display Panel (PDP) 100 according to a first embodiment of the present invention includes a front panel 120 and a back panel 130 facing the front panel 120. In FIG. 3, the front panel 120 is rotated at an angle of 90°. A front plate 22 is arranged on the front panel 120. A plurality of electrodes including X electrodes 23, Y electrodes 24, and bus electrodes 25 are arranged on the front plate 22.

The plurality of electrodes 23, 24, and 25 are arranged in predetermined patterns, for example, a stripe pattern or a zigzag pattern. If the PDP 100 according to the first embodiment of the present invention is an AC PDP, a front dielectric layer 26 can be arranged on the front plate 22 and a protective layer 27 is arranged on the front dielectric layer 26, as shown in FIG. 3. The back panel 130 facing the front panel 120 includes a back plate 132, a plurality of electrodes 135, and at least one ventilation hole 150. Furthermore, a barrier rib 137 and a phosphor layer 138 are arranged thereon, and when the PDP according to the first embodiment of the present invention is an AC PDP, a back dielectric layer 136 is arranged as shown in FIG. 3.

A plurality of address electrodes 135 are arranged on a surface of the back plate 132. The plurality of electrodes 135 on the back plate 132 are arranged in a predetermined pattern, for example, a stripe pattern or a zigzag pattern, to correspond to the electrodes 23, 24, and 25 arranged on the front plate 22. The front panel 120 and the back panel 130 are sealed together using a sealing unit 140, for example, a frit.

The at least one ventilation hole 150 is formed after arranging the address electrodes 135, the back dielectric layer 136, the barrier rib 137, and the phosphor layer 138 on the side of the back plate 132. The at least one ventilation hole 150 is used to remove gas remaining between the back plate 132 and the front plate 22 in order to maintain a vacuum state, and to induce a gas, such as Xe or Ne, into the PDP 100 in order to facilitate a discharge. In FIG. 3, an AC PDP according to the present invention is shown. However, the PDP of the present invention is not limited to an AC PDP. Any PDP that includes a front plate, a back plate, at least one ventilation hole in the back plate, and a plurality of electrodes, can comprise a PDP of the present invention.

Figure 4:
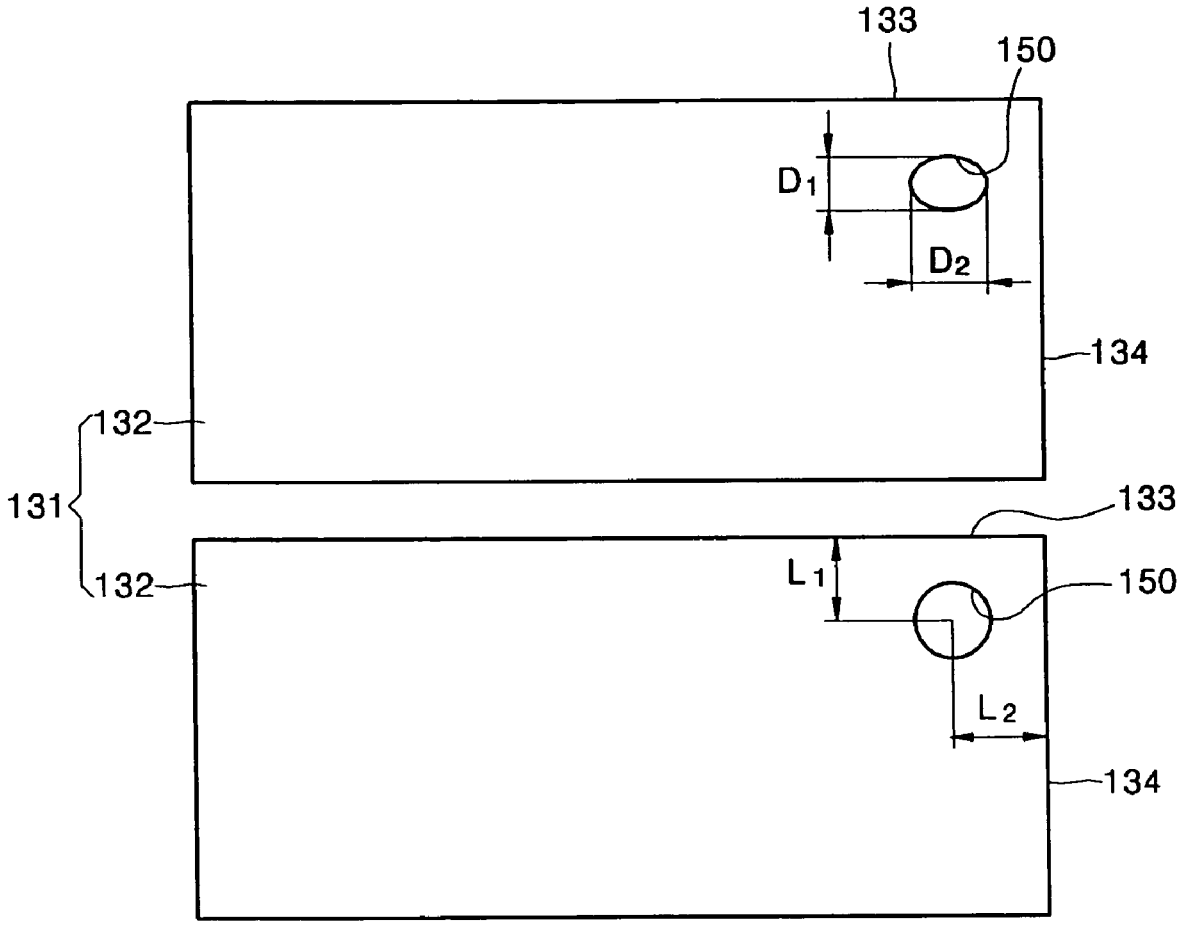
FIG. 4 is a plan view of a base plate of the PDP of FIG. 3.

As shown in FIG. 4, at least two back plates 132 are manufactured by cutting one base plate 131, on which at least two ventilation holes 150 are arranged. As an example, the back plate can be manufactured to have a width of 963 mm and a length of 582 mm, by cutting a center portion of a base plate having width of 963 mm and a length of 1164 mm. As shown in FIG. 4, two back plates 132 are formed using one base plate 131. However, three or more back plates can be formed using one base plate. At least one ventilation hole is formed on each of the back plates 132. Each ventilation hole 150 has a first width D1 in a first edge 133 direction and a second width D2 in a second edge 134 direction perpendicular to the first edge 133 direction.

It is desirable that a distance L1 from the first edge 133 to the center of the ventilation hole 150 be at least twice that of the first width D1. For example, if D1 is 7.5 mm, it is desirable that L1 is at least 15 mm.

Figure 5:
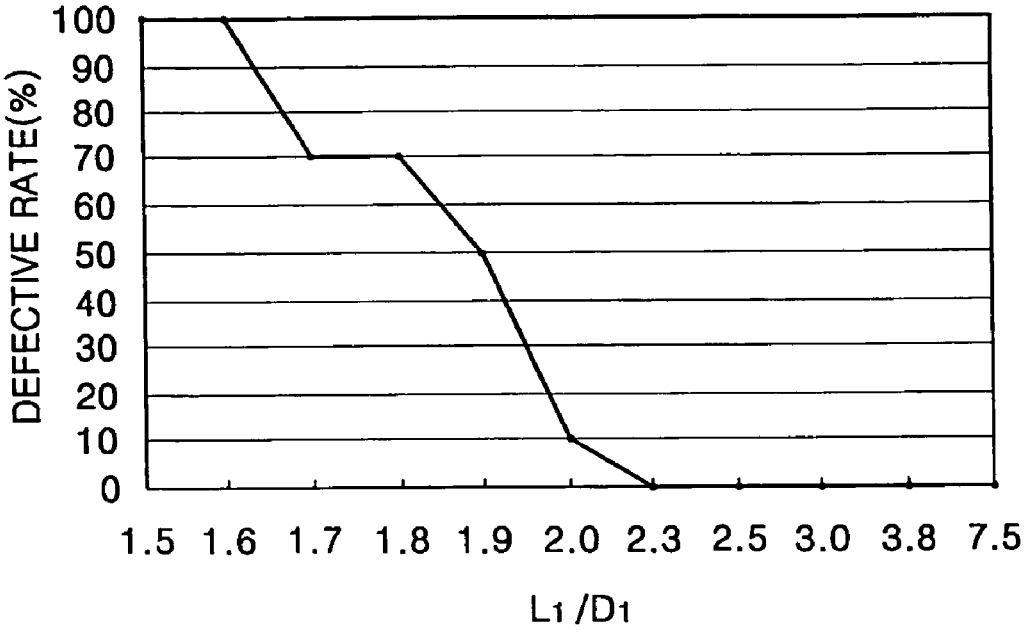
FIG. 5 is a graph of a defect rate of the back panel versus L1/D1 of aback plate in the PDP of FIG. 3.

As shown in the graph of FIG. 5, when the value of L1 is increased with respect to the value of D1, a defect rate of the back panel is reduced. In particular, when L1/D1 is nearly 2, the defect rate of the back panel is greatly reduced, and when L1/D1 is larger than 2, the defect rate is notably small. The defect rate of the back panel is the rate of either cracking around the ventilation hole during or after formation of the ventilation hole, or incurring damage around the hole during moving or operation of the back panel using a fixing unit such as a jig to secure the back panel.

As shown in FIG. 5, it is most desirable that the value of L1/D1 is at least 2.3, since there are fewest defects at that point.

Also, the ventilation hole 150 has the second width D2 in the direction of the second edge 134, which encounters the first edge 133 at a comer. It is desirable that a distance L2 from the second edge 134 to the center of the ventilation hole is at least 1.1 times the length of D2. For example, if D2 is 7.3 mm, it is desirable that L2 is at least 8 mm.

Figure 6:
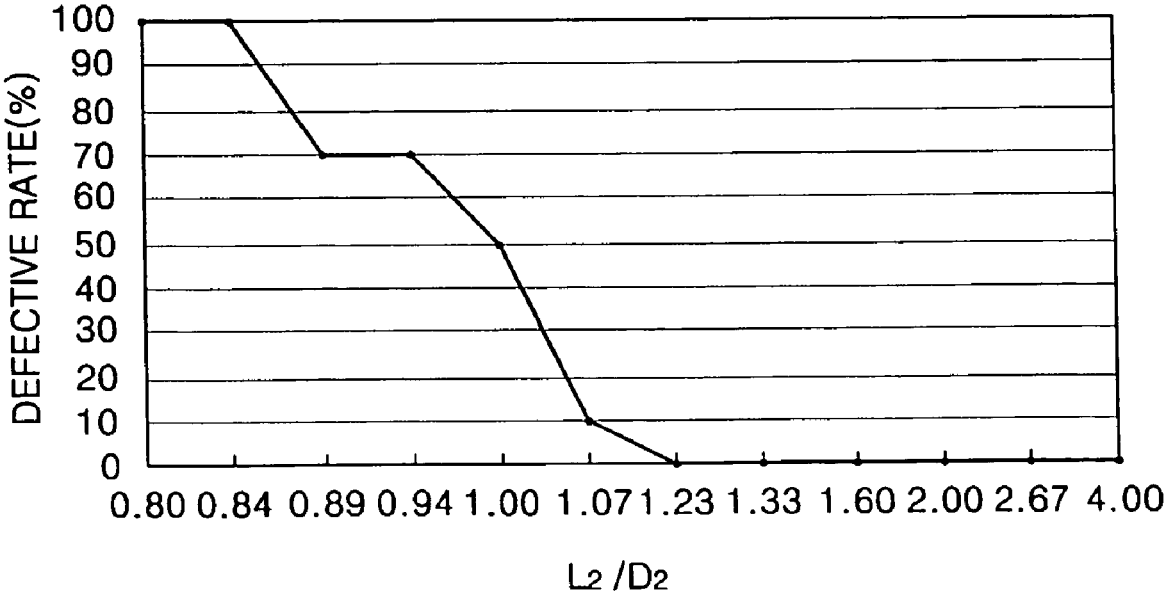
FIG. 6 is a graph illustrating a defect rate of a back panel versus L2/D2 of the back plate in the PDP of FIG. 3

As shown in FIG. 6, when the value of L2/D2 increases, the defect rate of the back panel is gradually reduced. When L2/D2 increases to 1.1, the defect rate of the back panel is reduced to less than 10%, and if L2/D2 is 1.23 or larger, the defect rate is substantially zero.

Thus, it is most desirable that the value of L2/D2 be at least 1.23.

It is desirable for the ventilation hole to be circular, since a circular cross section occupies less space and more gas can pass through a circular hole. Also, the ventilation hole corresponds to a ventilation pipe (not shown) that generally has a circular cross section.

Figure 7:
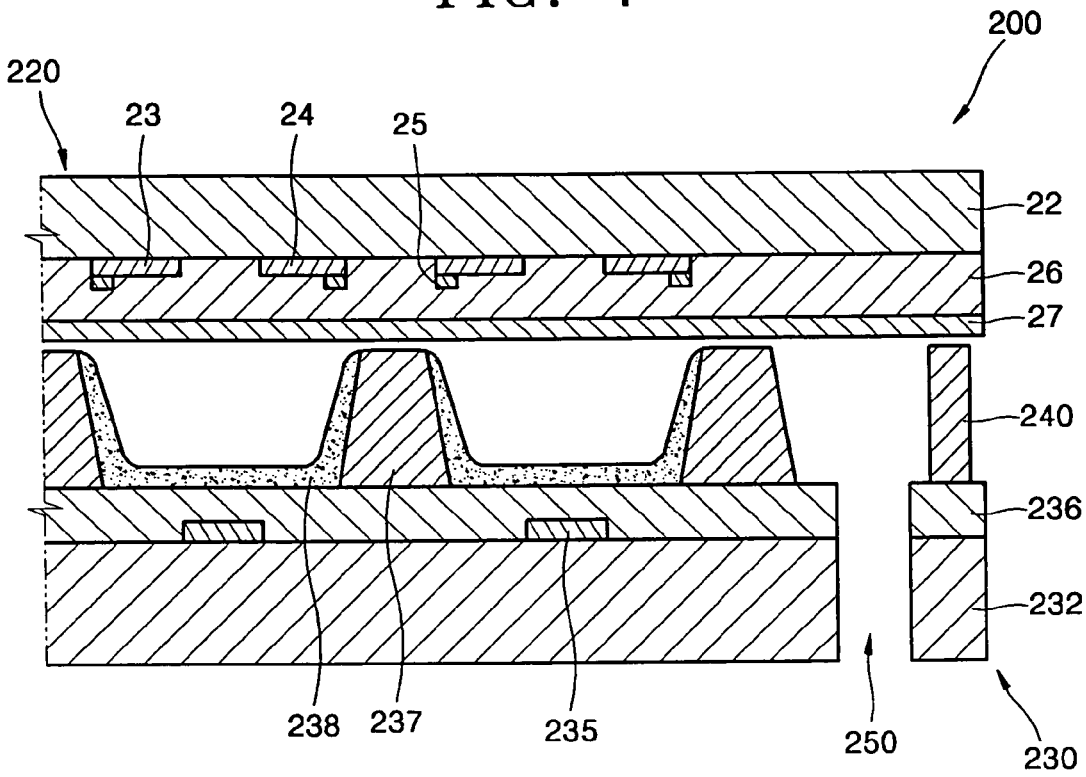
FIG. 7 is a cross-sectional view of a PDP according to a second embodiment of the present invention.

FIG. 7 is a view of a PDP 200 according to a second embodiment of the present invention. In FIG. 7, a front plate 22 is rotated by 90° for convenience.

Referring to FIG. 7, the PDP 200 according to the second embodiment of the present invention includes a front panel 220 having the front plate 22 and a plurality of electrodes 23, 24, and 25 arranged on a surface of the front plate 22 in a predetermined pattern. The PDP 200 also includes a back panel 230 having a back plate 232 facing the front plate 22, a plurality of electrodes 235 arranged on a surface of the back plate 232 corresponding to the electrodes of the front plate 22 and arranged in a predetermined pattern, and a ventilation hole 250.

The ventilation hole 250 is formed after forming the plurality of electrodes 235, a back dielectric layer 236, a barrier rib 237, and a phosphor layer 238 on a surface of the back plate 232. In addition, the front panel 220, on which the front plate 22 and the electrodes 23, 24, and 25 are arranged, and the plurality of electrodes 235, the back dielectric layer 236, the barrier rib 237, the phosphor layer 238, and the sealing unit 240 arranged on the back plate 232, are all the same as those of the front panel 120 included in the PDP 100 according to the first embodiment of the present invention, and accordingly, detailed descriptions thereof have been omitted for the sake of brevity.

Figure 8:
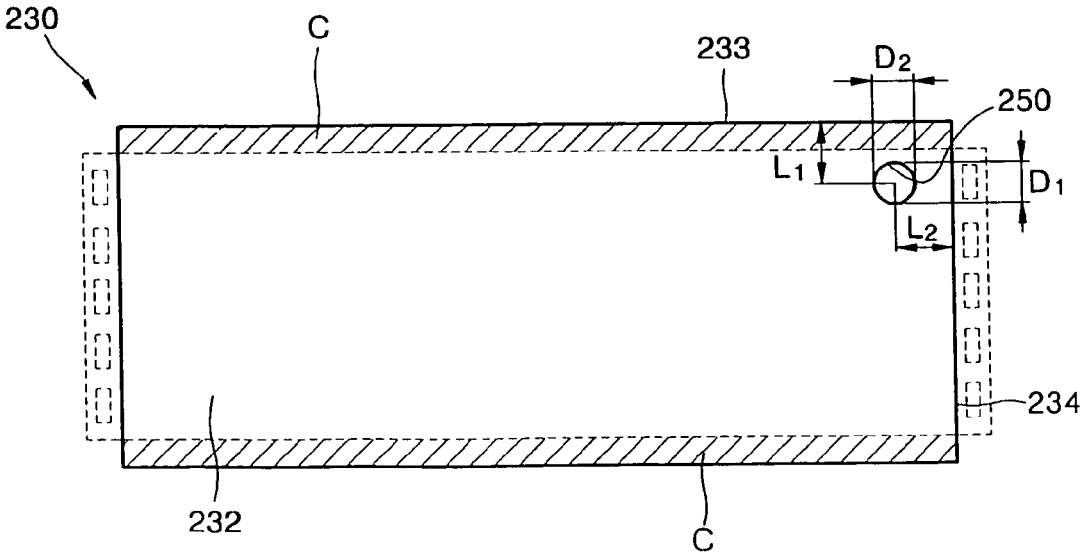
FIG. 8 is a plan view of a back panel of the PDP of FIG. 7.

As shown in FIG. 8, the ventilation hole 250 is formed on the back panel 230 of the PDP 200 according to the second embodiment of the present invention. An edge portion of the back panel 230 includes a first edge 233 including a back plate terminal area C and a second edge 234 that intersects the first edge 233.

The ventilation hole 250 has a first width D1 in the direction of the first edge 233, and it is desirable that a distance L1 from the first edge 233 to the center of the ventilation hole 250 be at least twice that of the first width D1. For example, if D1 is 7.5 mm, it is desirable that L1 is at least 15 mm. This is because when the value of L1/D1 increases, the defect rate of the back panel gradually decreases, and when L1/D1 approaches 2, the defect rate of the back panel is greatly reduced. Furthermore, when L1/D1 exceeds 2.3, the back panel defect rate is 0. Thus, it is most desirable that L1/D1 be at least 2.3.

Also, the back plate 232 has the second edge 234 that intersects the first edge 233, and the ventilation hole 250 has a second width D2 in the direction of the second edge 234. In addition, it is desirable that the distance L2 from the second edge 234 to the center of the ventilation hole 250 is at least 1.1 times that of the second width D2. For example, if D2 is 7.3 mm, it is desirable that L2 be at least 8 mm.

As shown in FIG. 6, as L2/D2 increases, the defect rate of the back panel gradually decreases, and when L2/D2 is near 1.1, the defect rate is reduced to less than 10%. In addition, if the value of L2/D2 is 1.23 or larger, the defect rate of the back panel is negligible. Thus, it is desirable for L2/D2 to be at least 1.23.

It is desirable for the ventilation hole 250 to be circular so that the ventilation hole 250 occupies less space and a larger amount of gas can pass through it. In addition, the ventilation hole 250 corresponds to a ventilation pipe (not shown) that generally has a circular cross section.

Figure 9A:
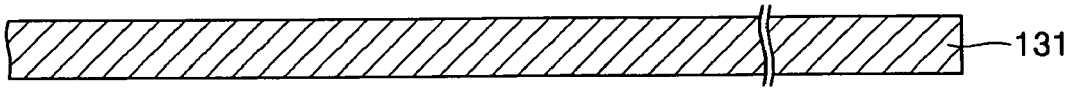
FIGS. 9A through 9D are cross-sectional views of a manufacturing process of the back panel of a PDP according to the first embodiment of the present invention.
Figure 9B:
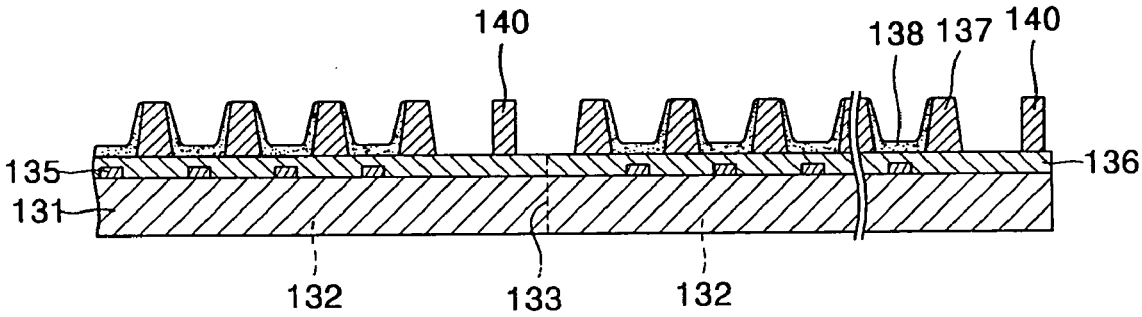
Figure 9C:
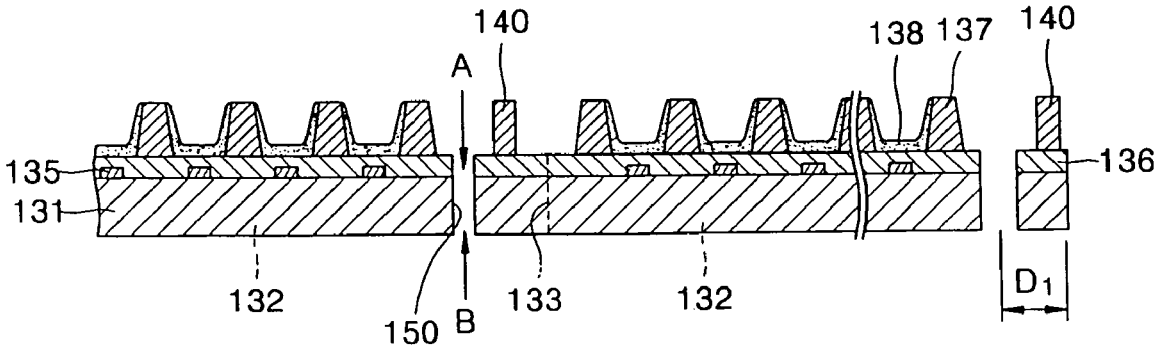
Figure 9D:
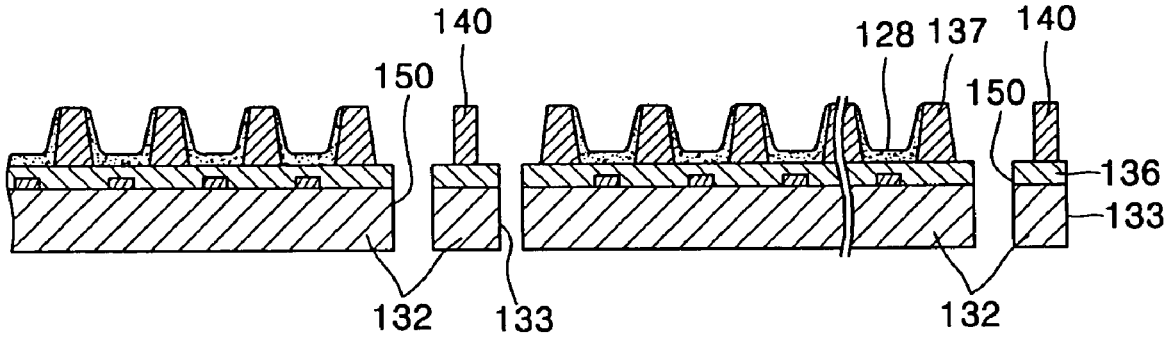

FIGS. 9A through 9D illustrate a method of manufacturing the back panel 130 in the PDP 100 according to the first embodiment of the present invention. Referring to FIGS. 9A through 9D, the method of manufacturing the back panel 130 of the PDP 100 according to a first embodiment of the present invention includes forming a plurality of electrodes 135 on the surface of the base plate 131 including a plurality of back plates 132 (FIG. 9B), forming at least one ventilation hole 150 on the back plate by drilling into the back plate at corresponding positions on upper and lower surfaces of the back plate 132 (FIG. 9C), and cutting the first edge 133 in the base plate 131 so that the base plate 131 can be divided into at least two back plates 132 (FIG. 9D). The base plate 131 is generally a glass substrate and includes two or more back plates 132.

First, the plurality of electrodes 135, that is, the address electrodes, are arranged on the surface of the base plate 131. As shown in the drawings, if the PDP is an AC PDP, the above step includes forming the back dielectric layer 136, the barrier rib 137, and the phosphor layer 138 on the plurality of electrodes 135. In the second step, the back plate 132 is drilled from corresponding positions A and B on the upper and lower surfaces so that the ventilation hole 150 can be formed with minimum damage due to drilling on either side of the back plate 132. Accordingly, the operation of forming the ventilation hole is completed inside the back plate 132 rather than on the surface of the back plate 132. Thus, cracks or irregularities are not generated on the surface around the ventilation hole 150, and the ventilation hole 150 can be easily coupled to the ventilation pipe (not shown).

Thus, it is desirable that the ventilation hole 150 be formed so that L1 is at least twice as long than D1, as shown in FIG. 4. As shown in FIG. 5, when L1/D1 approaches 2, the defect rate of the back panel is reduced greatly, and when L1/D1 is at least 2.3, the defect rate is negligible. Therefore, it is most desirable that the ventilation hole 150 is formed so that L1/D1 is at least 2.3.

Also, as shown in FIG. 4, it is desirable that the ventilation hole 150 is formed so that the distance L2 from the second edge 134 to the center of the ventilation hole 150 is at least 1.1 times that of the second width D2. This is because as L2/D2 approaches 1.1, the defect rate of the back panel is reduced, and if L2/D2 is at least 1.23, the defect rate of the back panel is 0%. Thus, it is most desirable that the value of L2/D2 is at least 1.23.

In the third step, the base plate 131 is cut to form a plurality of back panels 130.

According to the present invention, the size of the ventilation hole and separation distance from an edge of the back plate, which is formed by cutting one substrate including at least two ventilation holes, can be applied quantitatively to prevent damage around the ventilation hole during moving the back panel or during a jig process. Thus, the defect rate of the PDP can be reduced.

Also, since the hole forming process is completed inside the back plate, cracking around the ventilation hole can be prevented and the ventilation hole can be coupled to the ventilation pipe easily.

While the present invention has been particularly shown and described with reference to exemplary embodiments thereof, it will be understood by those of ordinary skill in the art that various changes in form and details can be made therein without departing from the spirit and scope of the present invention as recited by the following claims.

What is claimed is:

1. A plasma display panel comprising:

a front panel including a front plate;

a plurality of electrodes arranged on a surface of the front plate in a predetermined pattern;

a back panel including a back plate facing the front plate, the back plate having first and second edges;

a plurality of electrodes arranged on a surface of the back plate in a predetermined pattern to correspond to the plurality of electrodes of the front plate; and at least one ventilation hole having a first width in the first edge direction of the back plate and a distance from the first edge to a center of the at least one ventilation hole being at least twice that of the first width, the at least one ventilation hole substantially directly connecting a volume between the front and back panels to an external cylindrical ventilation pipe, and the at least one ventilation hole having a second width in a direction perpendicular to the first edge direction, and a distance from the second edge to the center of the at least one ventilation hole being at least 1.1 times that of the second width.

2. The plasma display panel of claim 1, wherein the distance from the first edge of the back plate to the center of the at least one ventilation hole is at least 2.3 times that of the first width.

3. The plasma display panel of claim 1, wherein the distance from the second edge to the center of the at least one ventilation hole is at least 1.23 times that of the second width.

4. The plasma display panel of claim 1, wherein the at least one ventilation hole has a circular shape.

5. The plasma display panel of claim 1, wherein the at least two of the back plates are formed by cutting up one plate on which at least two ventilation holes have been formed.

6. A plasma display panel comprising:

a front panel including a front plate and a plurality of electrodes arranged on a surface of the front plate in a predetermined pattern and having first and second edges; and a back panel including a back plate facing the front plate, a plurality of electrodes arranged on a surface of the back plate in a predetermined pattern to correspond to the plurality of electrodes of the front plate, and at least one ventilation hole;

wherein the at least one ventilation hole has a first width in a direction of the first edge of the back plate, on which a back plate driving terminal unit is arranged, and wherein a distance from the first edge to a center of the at least one ventilation hole is at least twice that of the first width, the at least one ventilation hole substantially directly connecting a volume between the front and back panels and an external cylindrical ventilation pipe, and the at least one ventilation hole having a second width in a direction perpendicular to the first edge direction, and a distance from the second edge to the center of the at least one ventilation hole being at least 1.1 times that of the second width.

7. The plasma display panel of claim 6, wherein the distance from the first edge to the center of the at least one ventilation hole is at least 2.3 times that of the first width.

8. The plasma display panel of claim 6, wherein the distance from the second edge to the center of the at least one ventilation hole is at least 1.23 times that of the second width.

9. The plasma display panel of claim 6, wherein the at least one ventilation hole has a circular shape.

10. The plasma display panel of claim 6, wherein the at least two of the back plates are formed by cutting up one plate on which at least two ventilation holes have been formed.

* * * * *